US007023325B2

(12) United States Patent
Arcaria

(10) Patent No.: US 7,023,325 B2
(45) Date of Patent: Apr. 4, 2006

(54) PROGRAMMABLE ELECTRONIC CIRCUIT

(75) Inventor: Angelo S. Arcaria, Wethersfield, CT (US)

(73) Assignee: Edwards Systems Technology, Inc., Cheshire, CT (US)

( * ) Notice: Subject to any disclaimer, the term of this patent is extended or adjusted under 35 U.S.C. 154(b) by 399 days.

(21) Appl. No.: 10/020,967

(22) Filed: Dec. 19, 2001

(65) Prior Publication Data

US 2003/0112129 A1 Jun. 19, 2003

(51) Int. Cl.
*G08B 3/10* (2006.01)

(52) U.S. Cl. ..... 340/384.7; 340/392.1; 340/392.4; 340/392.5

(58) Field of Classification Search ..... 340/384.7, 340/384.71, 384.1, 384.4, 384.5, 392.1, 393.4, 340/401.1, 392.4, 392.5, 395.1
See application file for complete search history.

(56) References Cited

U.S. PATENT DOCUMENTS

| | | | | |
|---|---|---|---|---|
| 3,609,020 | A * | 9/1971 | Kelly | 352/40 |
| 4,073,133 | A * | 2/1978 | Earls et al. | 340/484.1 |
| 4,110,750 | A * | 8/1978 | Heyning et al. | 340/384.1 |
| 4,215,339 | A * | 7/1980 | Durkee | 340/384.1 |
| 5,633,625 | A * | 5/1997 | Gaub et al. | 340/384.5 |
| 5,894,262 | A * | 4/1999 | McCavit et al. | 340/328 |
| 6,573,786 | B1 * | 6/2003 | Lee et al. | 348/632 |
| 2003/0003950 | A1 * | 1/2003 | Kroll et al. | 455/550 |

* cited by examiner

*Primary Examiner*—Jeffery Hofsass
*Assistant Examiner*—Daniel Previl
(74) *Attorney, Agent, or Firm*—Baker & Hostetler LLP

(57) ABSTRACT

A programmable electronic circuit is disclosed. The circuit includes a CPU, signal-generating circuitry, and RC circuitry having at least two capacitors, such that when both of the capacitors are switched into the RC circuitry by the CPU, a signal is produced from an output of the signal-generating circuitry that is longer in duration than when one of the capacitors is switched into the RC circuitry.

26 Claims, 2 Drawing Sheets

PROGRAMMABLE ELECTRONIC CIRCUIT

FIELD OF THE INVENTION

The present invention relates to electronic circuits for generating variable length output signals. More particularly, the present invention is directed to an electronic chime circuit.

BACKGROUND OF THE INVENTION

In industrial manufacturing environments, it is often desired to communicate to all of the employees that a process change has or is about to occur in order to synchronize the activities of the individuals who are working on different aspects of the process. Typically, industrial manufacturing facilities are large buildings or industrial complexes. The individuals who work on different aspects of the manufacturing process can therefore be at various locations within the manufacturing facilities.

To accomplish synchronization, chime devices that generate sounds, such as individual or groups of tones, are utilized to communicate information to the individuals at the manufacturing site. In addition, because industrial manufacturing environments often involve a large number of machines that generate a lot of noise during operation, chime devices are utilized to generate sounds that are distinguishable over the noisy environment.

The chimes generated from the chime devices may become inconsistent from one device to another because of unstable electrical components in the circuitry responsible for generating the chime. The instability of the chime circuitry can be attributed to the effects of the temperature at the location of the chime device on the circuit components. The output voltages of some circuit components, such as integrated circuits, transistors, and diodes, vary according to the ambient temperature.

In addition, circuit components, the performance of which depends on the voltage from the temperature-sensitive component, may not perform as expected if the voltage received by the dependent circuit component is not the voltage anticipated to be received by the dependent circuit component.

Accordingly, it is desirable to provide a chime device that has tone-generating circuitry that is not affected by variances in temperature. However, there are instances when an individual may want to purposely alter a tone. For example, an individual may want to extend the length of time that a particular chime plays. Accordingly, it is also desirable to provide tone-generating circuitry that is programmable to produce chime outputs of variable lengths.

SUMMARY OF INVENTION

In one aspect of the invention a programmable electronic device is provided that includes a CPU and signal-generating circuitry, wherein the signal-generating circuitry comprises RC circuitry having a first capacitor and a second capacitor, such that when the first capacitor is switched into the signal-generating circuitry by the CPU and the second capacitor is switched into the signal-generating circuitry by the CPU, an output signal is produced from the signal-generating circuitry that is greater in duration than when the first capacitor is switched into the signal-generating circuitry and the second capacitor is not switched into the signal-generating circuitry.

In another aspect of the invention a method for programming an electronic device is provided that includes generating a voltage square wave at a node of signal-generating circuitry, generating a charge voltage signal from the charging of at least two capacitors, which are switched into the signal-generating circuitry, that is greater in length than when one of the two capacitors is switched into the signal generating circuitry, inputting the charge voltage signal to an input of the adder circuit, outputting to the node the charge voltage signal during the time when a voltage of the voltage square wave is lower than the charge voltage, and outputting the voltage of the voltage square wave when the voltage of the voltage square wave is greater than the charge voltage.

In yet another aspect of the invention a programmable electronic apparatus is provided that includes a means for generating a voltage square wave at a node of signal-generating circuitry, a means for generating a charge voltage signal from the charging of at least two capacitors, which are switched into the signal-generating circuitry, that is greater in length than when one of the two capacitors is switched into the signal-generating circuitry, a means for inputting the charge voltage signal to an input of the adder circuit, a means for outputting an output signal to the node that is the charge voltage signal during the time when a voltage of the voltage square wave is lower the charge voltage, and a means for outputting an output signal that is the voltage of the voltage square wave to the node when the voltage of the voltage square wave is greater than the charge voltage signal.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

Figure 1:
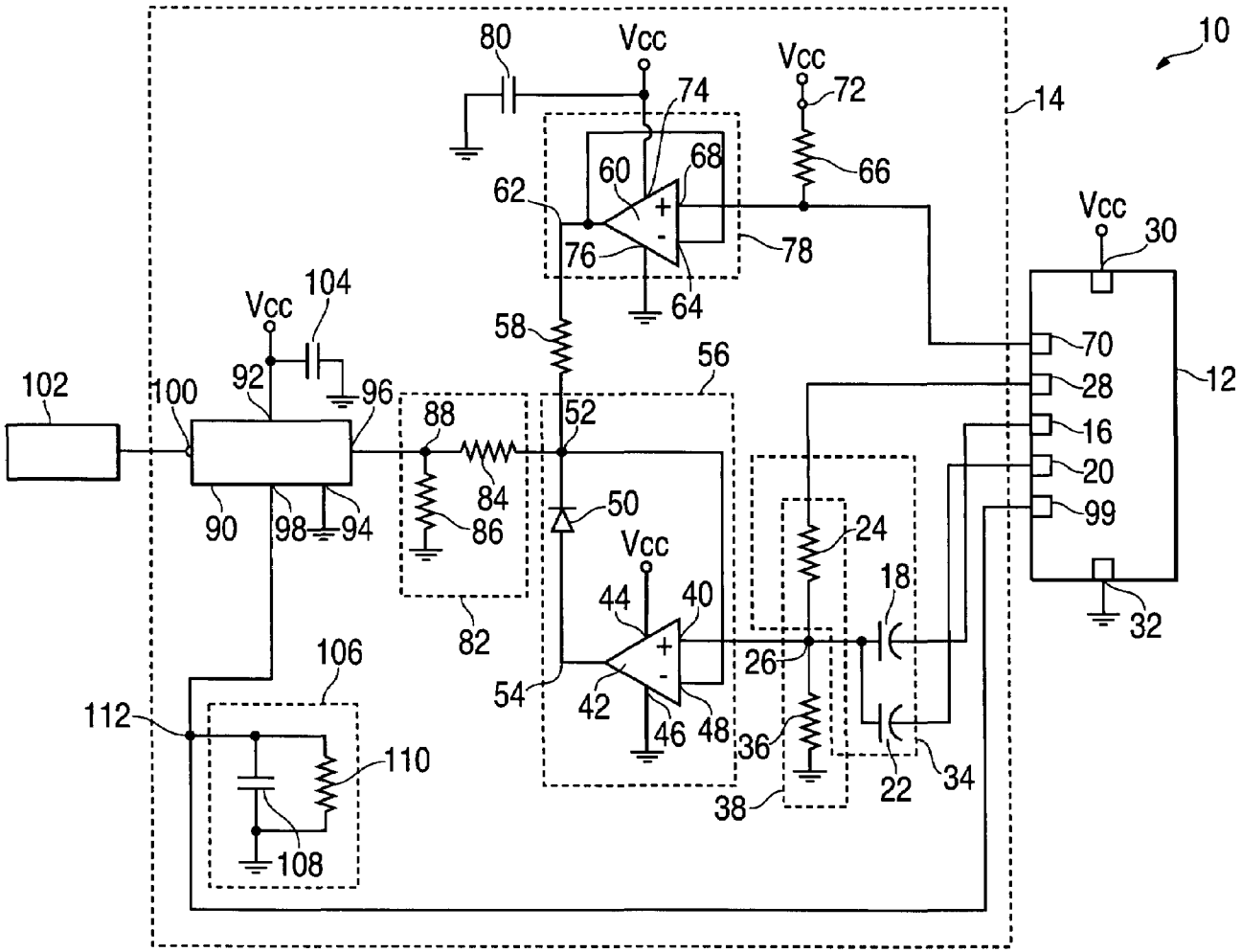
FIG. 1 is a circuit diagram of a chime circuit in accordance with the present invention.

Referring now to the figures, in FIG. 1 there is shown a programmable electronic circuit 10 that includes a CPU or microcontroller 12 and signal-generating circuitry 14.

In the description that follows, the circuit 10 of the present invention is described in connection with a chime circuit. It will be readily recognized that this same circuit can be used in any device which requires variable length sustained output signals.

A detailed circuit diagram of an exemplary programmable electronic circuit 10 in accordance with the present invention is shown in FIG. 1. As shown in FIG. 1, a CPU 12 is connected to signal-generating circuitry 14. A first terminal 16 of the CPU 12 is connected to a terminal of a first capacitor 18. A second terminal 20 of the CPU 12 is connected to a terminal of a second capacitor 22. The other terminals of the first capacitor 18 and the second capacitor 22 are connected to a first resistor 24 at node 26. The other terminal of the first resistor 24 is connected to a third terminal 28 of the CPU 12. In an exemplary embodiment of the present invention, the third terminal 28 of the CPU 12 is connected to a voltage supply of the CPU 12. The CPU is connected to a voltage supply and ground at terminals 30 and 32, respectively. In an exemplary embodiment of the present invention, the voltage supply at terminal 30 is 5V.

The first capacitor 18, the second capacitor 22, and the first resistor 24 form a first network 34, which may be referred to as an RC network. In an exemplary embodiment of the present invention the capacitance of the first capacitor 18 is 2.2 microFarads (μF), the capacitance of the second capacitor is 2.2 μF, and the resistance of the first resistor 24 is 118 KΩ.

The first resistor 24 is connected in series to one terminal of a second resistor 36 at node 26. The other terminal of the second resistor 36 is connected to ground. The first resistor 24 and the second resistor 36 form a first voltage divider circuit 38. In an exemplary embodiment of the present invention, the second resistor 36 has a resistance of a 243 kΩ. The voltage at node 26 is input to the non-inverting terminal 40 of a first operational amplifier 42. One terminal 44 of the first operational amplifier 42 is connected to a voltage supply and another terminal 46 of the first operational amplifier 42 is connected to ground. In an exemplary embodiment of the present invention, the voltage supply to the first operational amplifier 42 is 5V.

The inverting input 48 of the first operational amplifier 42 is connected to the cathode of a diode 50 at node 52. The anode of diode 50 is connected to the output of the first operational amplifier 42 at node 54. The diode 50 is part of a feedback loop between the output of the first operational amplifier 42 and the inverting input 48 of the first operational amplifier 42. The first operational amplifier 42 with the diode 50 in a feedback path from the output of the first operational amplifier 42 to the inverting input 48 of the first operational amplifier 42 is referred to as the adder operational amplifier network 56.

The diode 50 is part of the feedback loop of the first operational amplifier 42. The first operational amplifier 42 is therefore able to compensate for the normal forward voltage drop across the diode and voltage variances by the diode 50 due to ambient temperature variances. In addition, because the signal-generating circuitry 14 does not include any transistors, which are temperature-sensitive devices, voltage changes due to temperature variances are minimized or non-existent.

The cathode of diode 50 is connected to one terminal of a third resistor 58 at node 52. In an exemplary embodiment of the present invention the third resistor 58 has a resistance of 1.5 kΩ. The other end of the third resistor 58 is connected to a second operational amplifier 60. The second operational amplifier 60 has a feedback loop from the output at node 62 of the second operational amplifier 60 to an inverting input 64 of the second operator amplifier 60. One terminal of a fourth resistor 66 is connected to the non-inverting input 68 of the second operational amplifier 60 and to a fourth terminal 70 of the CPU 12. The other terminal of the fourth resistor 66 is connected to a voltage supply at node 72. In an exemplary embodiment of the present invention, the fourth resistor 66 has a resistance of 10 kΩ and the voltage supply is 5V. The fourth resistor 66 is provided between the input voltage at node 72 and the non-inverting input 68 of the second operational amplifier 60. In addition, the second operational amplifier 60 may have a terminal 74 connected directly to a voltage supply and a second terminal 76 connected directly to ground. The circuitry including the second operational amplifier 60, having its output voltage fed back to the inverting terminal 64 of the second operational amplifier 60, is referred to as the voltage follower/unity gain operational amplifier network 78.

In an exemplary embodiment of the present invention, one terminal of a third capacitor 80 is connected to the voltage supply at terminal 74 of the second operational amplifier 60. The other terminal of the third capacitor 80 is connected to ground. In an exemplary embodiment of the present invention the third capacitor 80 has a capacitance of 0.1 μF.

In an exemplary embodiment of the present invention, a second voltage divider circuit 82 is provided which includes a fifth resistor 84 and a sixth resistor 86. One terminal of the fifth resistor 84 is connected to diode 50 at node 52. The other terminal of the fifth resistor 84 is connected to one terminal of the sixth resistor 86 at node 88. The other terminal of the sixth resistor 86 is connected to ground. In an exemplary embodiment of the present invention, the fifth resistor 84 has a resistance of 2 kΩ and the sixth resistor 86 has a resistance 1 kΩ.

A tone controller/switch 90 is provided which has a first terminal 92 that is connected to a voltage supply and a second terminal 94 that is connected to ground. A third terminal 96 of the switch 90 is connected to the fifth resistor 84 and the sixth resistor 86 at node 88. A fourth terminal 98 the switch 90 is connected to the CPU 12, such that when a fifth terminal 99 of the CPU 12 is enabled, the voltage at node 88, which is the signal or chime generated from the signal-generating circuitry 14, is output at node 100 of the switch 90. In an exemplary embodiment of the present invention, the output signal generated at the fifth terminal 100 is fed to an amplifier 102, which may be external or internal to the signal-generating circuitry 14.

In an exemplary embodiment of the present invention, a fourth capacitor 104 having a capacitance of 0.1 μF is connected between the first terminal 92 of the switch 90 and ground.

Also, in an exemplary embodiment of the present invention, a second RC network 106 is provided. The second RC network includes a fifth capacitor 108 and a seventh resistor 110. One terminal of the fifth capacitor 108 is connected to the terminal 98 of the switch 90, terminal 99 of the CPU 12 and one terminal of the seventh resistor 110 at node 112. The other terminals of the fifth capacitor 108 and the seventh resistor 110 are connected to ground.

During operation of an exemplary embodiment of a programmable electronic circuit 10 in accordance with the present invention, a CPU 12, when enabled, outputs a voltage square wave having a maximum amplitude, for example 5V, to the unity gain operational amplifier network 78. A characteristic of the unity gain operational amplifier network 78 is that the output voltage at node 62 is equal to the input voltage to the second operational amplifier at node 68. Accordingly, the voltage square wave generated at the output of the unity gain operational amplifier network 78 is constant. Further, the unity gain operational amplifier network 78 acts as a voltage buffer to the voltage square wave coming from terminal 70 of the CPU 12 by isolating the voltage square wave output of terminal 70 from being loaded down by other components of the signal-generating circuitry 14.

In an exemplary embodiment of the present invention, a voltage supply at node 72 followed by resistor 66 contributes a voltage to the voltage output from the CPU 12 at terminal 70 to compensate for any loss in voltage that occurs during the transmission of the voltage output from terminal 70 of the CPU 12 to the non-inverting input 68 of the second operational amplifier 60.

Resistor 58 is provided between the output of network 78 and the diode 50 as a current limiter and a voltage dropping resistor.

To prevent the voltage square wave generated at node 52 from completely cutting off (e.g., to prevent an on-off pulsing chime signal), a first capacitor 18 is switched into the tone generating circuitry 14, by for example, connecting one terminal of the first capacitor 18 to ground at node 16 of the CPU 12, and by applying a dc voltage from terminal 28 to charge the first capacitor 18.

Figure 2:
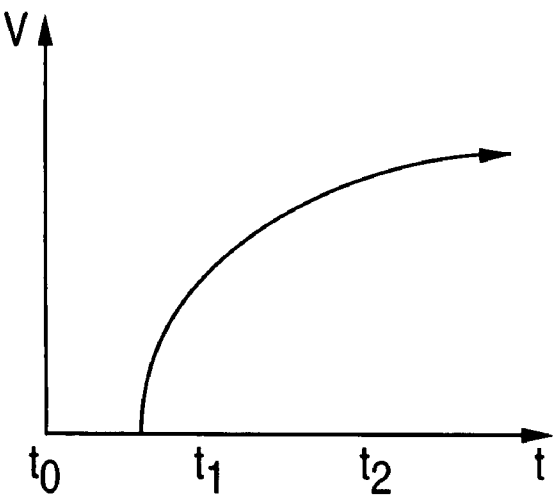
FIG. 2 is a graph illustrating the charging of a capacitor.

The resistor 24 is connected between the dc voltage output of the CPU 12 at terminal 28 and the terminal of the first capacitor 18 at node 26 to form circuitry of the first RC network 34. The first RC network causes the charging time of the capacitor to increase. FIG. 2 illustrates how the voltage of the capacitor 18 increases over time. The first voltage divider network 38 establishes the maximum and/or predetermined charge voltage for the first capacitor 18. At time t, the RC voltage at node 26 will correspond to the charge voltage on the capacitor at time t.

Figure 3:
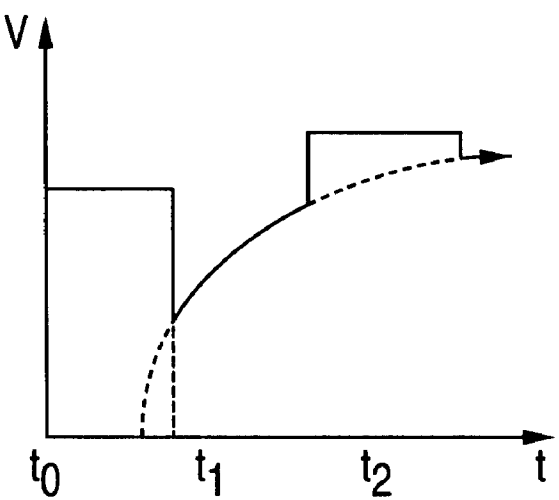
FIG. 3 is a graph of a signal output from signal-generating circuitry in accordance with the present invention.

The adder operational amplifier network 56 operates, such that when the voltage square wave at node 62 is higher than the voltage at node 52, the diode blocks sinking action from the adder operational amplifier network 56. As shown in FIG. 3, during the time period, e.g., the time period between $t_0$ and $t_1$, the output voltage at node 62 will correspond to the voltage square wave at node 52 during that time period. During the time period, for example the time period between $t_1$ and $t_2$ when the voltage square wave at node 62 is lower than the voltage at terminal 40/node 26, the diode 50 allows current to flow in the forward direction and the voltage at node 52 will correspond to the voltage across capacitor 18 (i.e., the voltage at node 26) as it charges during the time period between $t_1$ and $t_2$. The output between $t_1$ and $t_2$ is illustrated in FIG. 3.

An output signal is no longer generated from the adder circuit 56 when the charge voltage equals a maximum and/or predetermined voltage of the voltage square wave. A characteristic of the first operational amplifier 42 is that it does not sink and/or source current when the voltages at both of its inputs are equal.

As a result, the output signal during the time the first capacitor 18 is charging can be described as a voltage square wave of a fixed period that is superimposed over an exponentially increasing waveform, as shown in FIG. 3.

The voltage divider circuit 82 reduces the signal at node 52 before it is input to the switch 90. When the output signal at node 88 is desired to be output from the signal-generating circuitry 14, the switch 90 is enabled and the output signal at node 88 is output from the switch 90 at node 100.

If a user of the programmable electronic device desires a chime output of a different length, the user can selectively switch in or switch out another capacitor to or from the first RC network 34.

In an exemplary embodiment of the present invention, a second capacitor 22 is switched into the network 34. Accordingly, the total capacitance of the network 34 is increased because the charging of capacitors 18 and 22 takes longer to charge to their maximum charge voltage than it would, for example, if only capacitor 18 was being charged. Thus, the waveform shown in FIG. 2 will also increase. Accordingly the waveform generated in FIG. 3 will also become longer and a signal, for example a chime signal, will be generated that is longer in duration than if only, for example, the first capacitor 18 was switched into the network 34.

It should be understood that in various exemplary embodiments the numbers and values of the resistors and capacitors may vary. It should also be understood that the components utilized may be integrated into packaged devices.

In exemplary embodiments of the present invention, the voltage supply to the components of the chime circuit 10 is 5V. It should also be understood the number of voltage supplies and the values of the voltage supplies may vary.

It should also be understood that the voltage supplies connected directly to the terminals of the operational amplifiers and the switch are present if it is desired to bias the operational amplifiers and switch, such that they are operating at their optimal characteristics. Although not necessary capacitors, such as capacitors 80 and 104, and/or RC networks, such as network 106 may be connected between the voltage supplies of the programmable electronic circuit 10 and ground and to prevent any transient voltages, i.e., any voltages greater than the operating voltages of the circuit from harming the circuitry to which the power supply is connected. Transient voltages are voltage spikes that may be generated when the voltage supplies are turned on.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An electronic device comprising:

a CPU; and a signal-generating circuit, wherein the signal-generating circuitry comprises RC circuitry having a first capacitor and a second capacitor, the first and second capacitors are detachably coupled to signal-generating circuit and are switched into the signal generating circuit by the CPU to extend the length of an output signal.

2. The electronic device of claim 1, wherein the CPU outputs a voltage square wave.

3. The electronic device of claim 2, wherein the signal-generating circuitry further comprises a unity follower circuit that buffers the voltage square wave and generates a buffered voltage.

4. The electronic device of claim 3, wherein the signal-generating circuitry further comprises an adder circuit that receives a buffered voltage.

5. The electronic device of claim 4, wherein the CPU outputs a dc voltage to the RC circuitry.

6. The electronic device of claim 5, wherein the signal-generating circuitry further comprises a first voltage divider circuit that establishes a charge voltage on the first capacitor when it is switched into the signal-generating circuitry and on the second capacitor when it is switched into the signal-generating circuitry.

7. The electronic device of claim 4, wherein the charge voltage is input to a first terminal of the adder circuit.

8. The electronic device of claim 7, further comprising a diode, wherein the diode is in a feedback loop of the adder circuit.

9. The electronic device of claim 8, wherein the diode allows the feedback loop to conduct current when the buffered voltage is less than the charge voltage.

10. The electronic device of claim 8, wherein the diode does not allow feedback loop current when the buffered voltage is greater then the charge voltage.

11. The electronic device of claim 1, wherein the signal generating circuit is substantially not affected by an ambient temperature surround the signal generating circuit.

12. The electronic device of claim 11, wherein the signal circuit does not include transistors.

13. A method for programming a chime device, comprising:

generating a voltage square wave at a node of signal-generating circuitry;

generating a charge voltage signal from charging a detachable first capacitor;

if needed, switching a detachable second capacitor into the signal generating circuit by a CPU to extend the length of charge voltage;

inputting the charge voltage to an input of the adder circuit;

outputting to the node the charge voltage signal during the time when a voltage of the voltage square is lower than the charge voltage; and outputting the voltage of the square wave when the voltage of the voltage square wave is greater then the charge voltage.

14. The method of claim 13, further comprising:

generating the voltage square wave from buffer circuitry.

15. The method of claim 13, further comprising:

utilizing voltage divider circuitry to establish the charge voltage.

16. The method of claim 13, wherein the signal generating circuit is substantially not affected by an ambient temperature surround the signal generating circuit.

17. The method of claim 16, wherein the signal circuit does not include transistors.

18. A programmable electronic apparatus, comprising:

means for generating a voltage square wave at a node of a signal-generating circuitry;

means for generating a charge voltage signal from charging a detachable first capacitor, in the signal-generating circuitry;

if needed, means for switching a detachable second capacitor into the signal generating circuit by the CPU to extend the charge voltage signal;

means for inputting the charge voltage signal to an input of the adder circuit;

means for outputting an output signal to the node that is the charge voltage signal during the time when a voltage of the voltage square wave is lower the charge voltage;

means for outputting an output signal that is the voltage of the voltage square wave to the node when the voltage of the voltage of the square wave is greater than the charge voltage signal.

19. The programmable electronic apparatus of claim 18, wherein the means for generating a voltage square wave is a buffer.

20. The programmable electronic apparatus of claim 18, wherein the means for generating the charge voltage signal is a dc voltage source.

21. The programmable electronic circuit apparatus of claim 18, wherein the means for inputting the charge voltage signal to an input of the adder circuit is RC circuitry.

22. The programmable electronic apparatus of claim 18, wherein the means for outputting to the node the charge voltage.

23. The programmable electronic apparatus of claim 18, wherein the electronic apparatus is a chime device.

24. The programmable electronic apparatus of claim 18, wherein the output signal is a chime.

25. The programmable electronic apparatus of claim 18, wherein the signal generating circuit is substantially not affected by an ambient temperature surround the signal generating circuit.

26. The programmable electronic apparatus of claim 18, wherein the signal circuit does not include transistors.

* * * * *